United States Patent [19]

Tolliver

[11] 4,345,626

[45] Aug. 24, 1982

[54] CIRCUMFERENTIAL STIRRUP PANEL

[76] Inventor: Wilbur E. Tolliver, 364 Hamilton Dr., Holland, Mich. 49423

[21] Appl. No.: 265,443

[22] Filed: May 20, 1981

Related U.S. Application Data

[63] Continuation of Ser. No. 36,171, May 4, 1979, abandoned.

[51] Int. Cl.[3] ..... B21F 27/22

[52] U.S. Cl. ..... 140/107; 245/2

[58] Field of Search ..... 140/92.1, 92.2, 7, 10, 140/13, 14, 107; 245/2; 138/175

[56] References Cited

U.S. PATENT DOCUMENTS

| | | | |
|---|---|---|---|
| 3,411,545 | 11/1968 | Keyser | 138/175 |
| 3,578,036 | 5/1971 | Francois | 140/107 |
| 3,838,837 | 10/1974 | Tolliver | 138/175 |
| 3,840,054 | 10/1974 | Tolliver | 138/175 |
| 3,841,591 | 10/1974 | Tolliver | 138/175 |

*Primary Examiner*—John McQuade

*Attorney, Agent, or Firm*—Price, Heneveld, Huizenga & Cooper

[57] ABSTRACT

The specification discloses a method and associated products for adding stirrup reinforcements to a concrete pipe reinforcing cage in which a mat composed of a plurality of sinusoidal shaped stirrup members joined by tie wires is joined to a cage with the sinusoidal stirrup members oriented circumferentially with respect to the cage rather than longitudinally.

8 Claims, 6 Drawing Figures

CIRCUMFERENTIAL STIRRUP PANEL

This is a continuation of application Ser. No. 36,171, filed May 4, 1979, now abandoned.

BACKGROUND OF THE INVENTION

The present invention relates to stirrup reinforcements for a concrete pipe reinforcing cage. Concrete pipe is typically reinforced by a wire cage comprised of a plurality of circumferential wires joined to a plurality of longitudinal wires extending the length of the cage. Often it is desirable to add additional reinforcement known as stirruping. Stirrups traditionally comprise short lengths of steel wire or rod projecting generally radially from the cage, usually in the areas adjacent to the crown and invert of the cage.

To avoid having to weld a plurality of separate short rods to the cage, prior artisans often employ a generally sinusoidal shaped wire and located in the cage so that it extends longitudinally down the cage with the nose of the sinusoidal member projecting radially from the cage. Heretofore, I have conceived and developed the concept of providing stirrup mat with projections extending therefrom in a plurality of parallel rows. One type of mat which I developed includes circumferentially oriented tie wires which can be manually shaped to conform to the cylindrical configuration of the reinforcing cage at the crown or invert areas thereof so that by manually shaping and locating a single mat (or perhaps two or three for very large pipe or several for 360° (stirruping) at the crown or invert area, one completely stirrups that area in a single operation.

I have also conceived and developed a mat in which differentially sized and spaced stirrups are employed. By placing the stirrups closer together in the area immediately adjacent the crown or invert and spacing them farther apart in the more remote areas, and/or by employing taller stirrups in the central area, I concentrate the steel where it is most needed to reinforcement purposes. This invention is disclosed and claimed in my copending patent application Ser. No. 036,170 entitled VARAGATED STIRRUP MAT, now U.S. Pat. No. 4,295,497.

Another invention of mine which is particularly desirable where the tops of stirrup projections have to be tied together, as for example in producing arch pipe, is that in which longitudinal lines of stirrup members are hinged to a supporting mat. This enables one to flatten the hinged members and stack mats on top of one another.

SUMMARY OF THE INVENTION

Now, I have developed yet another revolutionary approach to stirruping which makes manual shaping of the stirrup mat even simpler and which makes it easier to produce varegated stirrup mats with differential spacing and/or stirrup height. Further, mats made in accordance with the present invention can be stacked one on top of the other even where the tops of the stirrups are tied together, without the need to hinge the various rows of stirrups to the mat.

In the present invention, I provide a mat in which generally sinusoidal shaped stirrup members are tied together by tie wires, but are oriented to correspond to the circumferential wires of a cage rather than the longitudinal wires. In essence, this provides two projecting stirrups at a single stirruping location, i.e. each side of a node of the sinusoidal member. As a result, the wire diameter can be half the normal diameter for stirruping for a given purpose and the antenode portions of the wire are therefore narrower and more easy to bend then they would otherwise be. Flexing of the sides of the nodes in bending of the mat further enhances the bendability thereof. Hence, the present invention lends itself advantageously for use in my manual forming stirrup mat method.

Differential spacing and stirrup height are more easily achieved by being able to bend a single length of wire differentially as it proceeds through a bender. Previously, one had to carefully locate longitudinally extending stirrup members at appropriate locations and spaces for welding to circumferentially tie wires and the machinery required to achieve this is more complicated and more subject to error than the bending apparatus required to produce a mat in accordance with the present invention.

Finally, even when the tops of the nodes of the stirrup members in the mat of the present invention are tied together by longitudinal top tie wires extending longitudinally down the mat, the mat of the present invention can be stacked on top of the next succeeding mat. Because the nodes are open at the bottom, they fit right over the tie wire without interference. This cannot be achieved by a conventional mat or by a mat in which sinusoidal wires extend longitudinally. (Compare FIGS. 5 and 6).

These and other objects, advantages and features of the invention will be more fully understood and appreciated by reference to the written specification and appended drawings.

DESCRIPTION OF THE PREFERRED EMBODIMENTS

Figure 1:
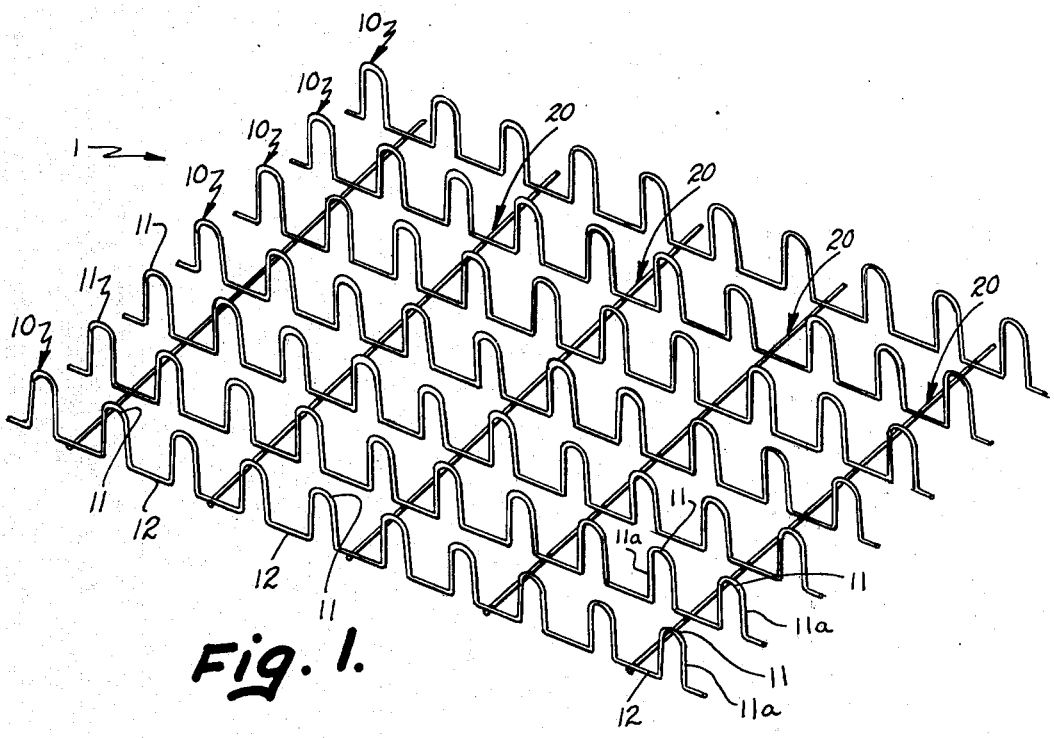
FIG. 1 is a perspective view of a mat made in accordance with the present invention.

In the preferred embodiment, the stirrup reinforcing mat 1 is made of conventional reinforcing steel wire. (FIG. 1) It is comprised of a plurality of generally sinusoidal stirrup members 10 oriented for circumferential location within a pipe reinforcing cage 40 (FIG. 2). Cage 40 includes circumferential wires 41 and longitudinal wires 43. Members 10 extend generally parallel to the circumferential wires 41. Stirrup members 10 are then joined together by a plurality of tie wires 20 which are oriented so as to extend longitudinally with respect to a pipe reinforcing cage 40 and generally parallel to wires 43.

Figure 2:
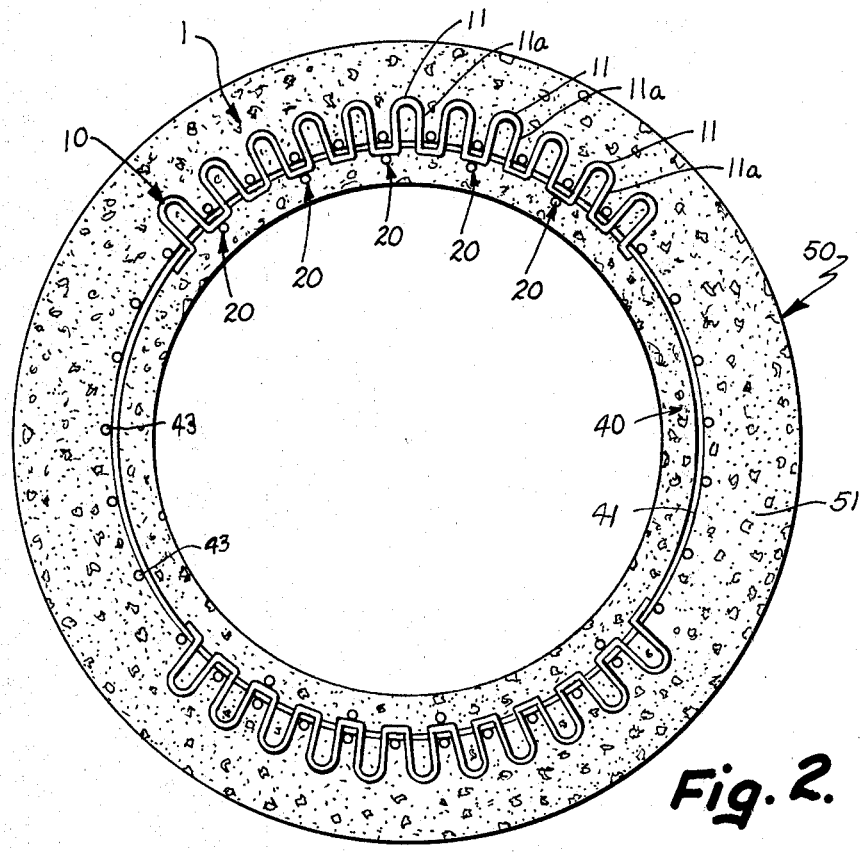
FIG. 2 is a cross sectional view of a concrete pipe and its associated reinforcing cage as stirruped in accordance with the present invention.

Stirrup members 10 are described as "generally" sinusoidal in that it is preferable that the antenodes 12 be flat as shown in FIG. 1, rather than truly sinusoidal in shape. The resulting mats fit more easily and snuggly inside reinforcing cage 40. The stirrup members are oriented generally parallel to one another with their antenodes lying in a base plane and with their nodes 11 projecting out of the base plane. Each side 11*a* of each node 11 then does the bulk of the actual stirruping work.

The tie wires 20 lie within the base plane defined by the antenodes and tie wires 20 are welded to the stirrup members 10 at various antenodes. It is not necessary that each and every row of antenodes be joined by a tie wire. Rather, as few as five or six longitudinal tie wires may be sufficient depending on the size of reinforcing mats required.

The resulting mat 1 is then oriented within a pipe reinforcing cage 40 as illustrated in FIG. 2. Each mat 1 is designed to subtend an arc of from 45° to 60° to either side of the crown or invert of a cage and of the resulting pipe. The mat is manually shaped to conform to the general curvature of the cage 40 at the crown or invert thereof and is then pushed into place within cage 40. The manual shaping operation is enhanced by the relative springyness between the sides 11*a* of the nodes 11 and by the fact that a smaller diameter wire can be used for stirrup members 10 in view of the fact that at each stirruping location, one has two projecting wires 11*a*. When mat 1 is in place with the generally sinusoidal stirrup members 10 oriented circumferentially with respect to cage 40, the resulting assembly is placed within a concrete pipe forming machine and concrete 51 is cast there around or packed there around to create a resulting concrete pipe 50.

While I have described inserting mat 1 into position from the inside of cage 40, it is also possible to place mat 1 in position on the outside of cage 40 with stirrups 10 projecting generally radially inwardly through cage 40. Thus, while the stirrups 10 are oriented generally radially in both instances, in one case they may be projecting inwardly towards the interior of cage 40 and in the other projecting outwardly away from the interior of cage 40.

The term generally radially is intended to give only an approximate indication of the orientation of stirrup members 10. Some prior artisans actually purposely deviate the angle of orientation of stirrups 5, 10 or as much as 30° or 40° from true radial. Such orientation would still, for purposes of this invention be oriented generally radially.

Figure 3:
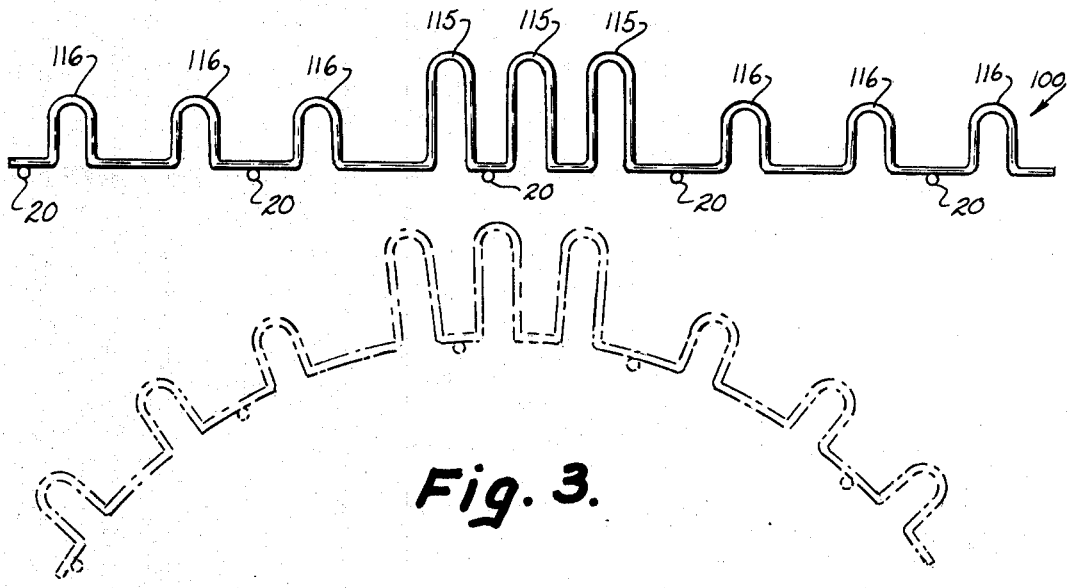
FIG. 3 is an end elevational view of a mat made in accordance with the present invention wherein the circumferential sinusoidal stirrup members include projections which are taller and more closely spaced in the central area of the mat than they are to either side.

FIG. 3 illustrates a variation of mat 1 in which the generally sinusoidal stirrup members 100 are varegated. That is to say, they have central projecting nodes 115 which are taller and more closely spaced together than the nodes 116 located to either side of the central area. This concentrates more stirrup reinforcing steel immediately adjacent the crown or invert of the pipe where it is most needed. Such varegation can readily be achieved in producing mats in accordance with the present invention by simply properly programming the bending machine which bends each individual stirrup member 100.

Figure 4:
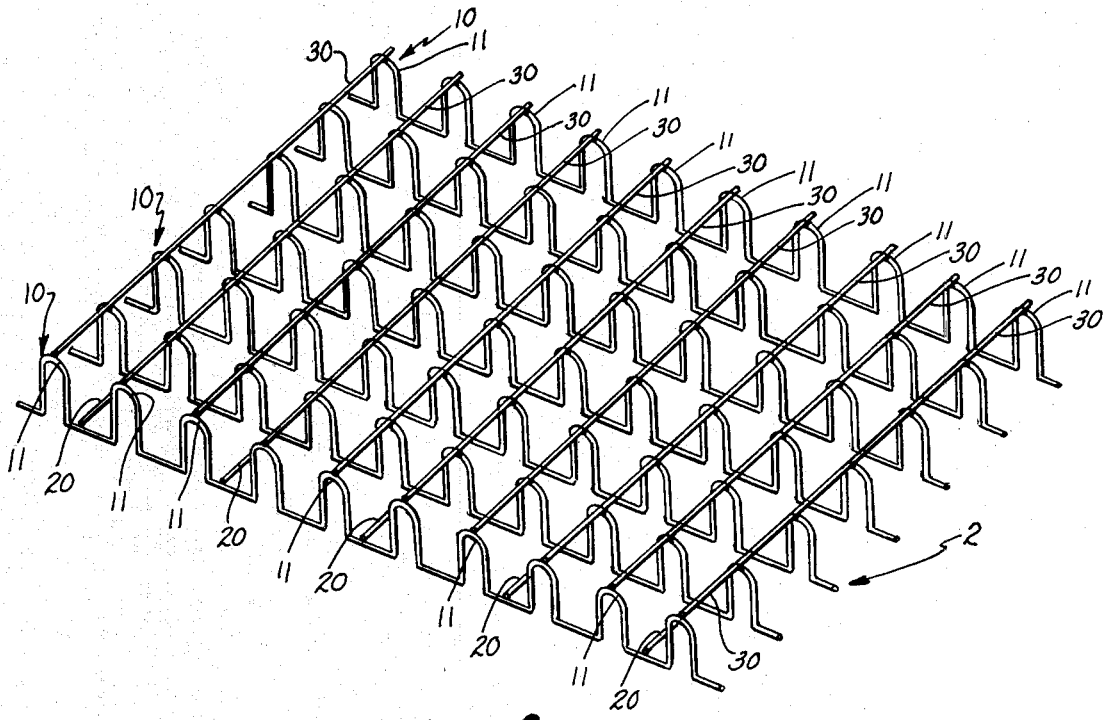
FIG. 4 is a perspective view of a mat made in accordance with the present invention wherein the tops of the nodes of the stirrup projections are bound together by longitudinal tie wires.

FIG. 4 discloses a variation 2 of stirrup mat 1 in which the nodes 11 of adjacent stirrup members 10 are joined together along their tops by tie wires 30 which extend longitudinally of the mat and which are oriented longitudinally in a cage. Such a mat would have to be wrapped around the outside of a cage 40, rather than inserted through from the inside thereof (as is the mat 1 shown in FIG. 2) since the top tie wire 30 would interfere with the circumferential wires of the cage. Such top tie wires 30 are often specified for use in conjunction with stirruping.

Figure 5:
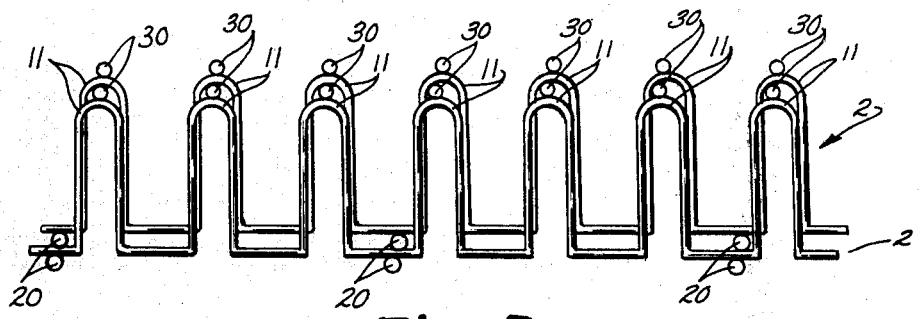
FIG. 5 is an end elevational view of mats made in accordance with FIG. 4 stacked one on top of the other.

The FIG. 4 mat can be stacked on top of other like mats as is illustrated in FIG. 5. The opening at the bottom of each node 11 slips down over the next succeeding top tie wire 30. Thus, these mats form a fairly compact stack, even without hinging the stirrup member 10 to the mat. (In FIG. 5, the stack is purposely skewed to the right slightly for illustrative conveniences.)

Figure 6:
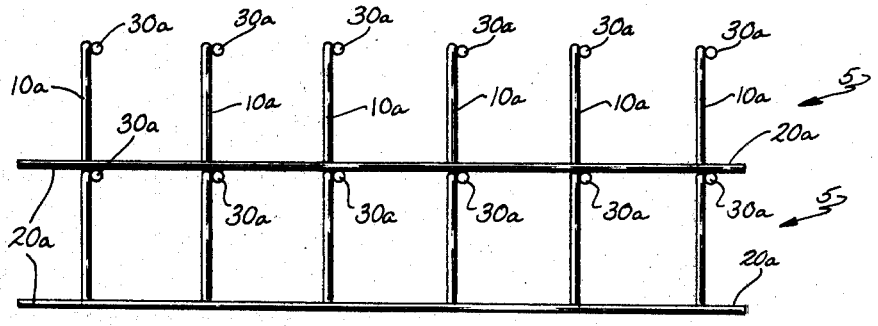
PRIOR ART Fig. 6.
FIG. 6 is an illustration of a prior art mat in which the tops of the stirrup projections are tied together by longitudinal tie wires illustrating that such mats will not stack compactly one on top of the other.

A prior art mat such as mat 5 shown in FIG. 6 would not stack in this way since the top tie wires 30*a* would interfere with the circumferentially oriented bottom tie wires 20*a* which are used to join the longitudinally extending stirrup members 10*a* together. This would be true whether stirrups 10*a* were longitudinally extending sinusoidal members or just a plurality of short rods.

As regards the terms "longitudinally" and "circumferentially" used herein, they are intended to refer to the orientation of the various strands of wires after they are placed in a generally cylindrical pipe reinforcing cage 40. Each mat is designed so that its stirrup members 10 are oriented circumferentially and its tie wires 20 are oriented longitudinally after the mat is placed in a cage. Thus the length of the individual stirrup members 10 is designed to coordinate to the diameter of the pipe reinforcing cage 40 in that each stirrup member 10 must be sufficiently long that it subtends the desired circumferential arc to either side of the crown or invert of the cage. Typically, this arc extends some 45° to 60° to either side of the crown or invert.

The "longitudinal" tie wires 20 will typically be sufficiently long to extend generally the length of a pipe reinforcing cage 40. However, one may in the case of particularly large pipe wish to provide two separate mats 1, each of which is approximately half the length of the cage so that two such mats 1 are employed to stirrup the cage at the crown and invert.

Also, while I have discussed stirruping at the crown and invert in particular, there are also some instances in which stirruping such as provided by mat 1 is located in the area adjacent the spring line of the cage and resulting pipe. The principles involved in the present invention are the same for such location.

Of course it is understood that the above are merely preferred embodiments of the invention and that various changes and alterations can be made without departing from the spirit and broader aspects thereof as defined by the claims set forth hereinbelow and by the range of equivalency allowed by law.

The embodiments of the invention in which an exclusive property or privilege is claimed are defined as follows:

1. A method for adding stirrup reinforcement to a concrete pipe reinforcing cage comprising the steps of: providing a mat comprised of a plurality of generally sinusoidal shaped stirrup members, each stirrup member including a plurality of nodes and antenodes, said stirrup members being oriented generally parallel to one another with said antenodes lying in a base plane and with said nodes projecting from said base plane, and said mat further including a plurality of tie wires joined to said stirrup members, said tie wires being oriented generally parallel to one another and generally perpendicular to said stirrup members; shaping said mat so that said stirrup members conform generally in curvature to the curvature of a cage to be reinforced at the area to be reinforced; and joining said mat to a pipe reinforcing cage with each of said sinusoidal stirrup members oriented to extend circumferentially with respect to said cage and with said tie wires oriented to extend longitudinally with respect to said cage.

2. The method of claim 1 in which said step of providing said mat includes providing sinusoidal stirrup members having generally flat antenodes.

3. The method of claim 2 which comprises:

determining a first diameter of wire necessary for a longitudinal sinusoidal stirrup reinforcement, were such to be used to reinforce a concrete pipe reinforcing cage of the desired size and configuration, in which each of such longitudinal sinusoidal stirrup members would be oriented to extend longitudinally with respect to a cage;

said step of providing said circumferentially oriented mat then including providing a mat of sinusoidal stirrup members in which the wire used in said generally sinusoidal stirrup members has a second diameter which is approximately half said first diameter of wire.

4. The method of claim 2 in which the tops of said nodes of adjacent stirrup members are joined together by top tie wires which extend generally parallel to each other and to said bottom tie wires.

5. The method of claim 1 in which said nodes are spaced more closely together towards the center of each said stirrup members than they are toward the ends of the stirrup member.

6. The method of claim 5 in which said nodes are taller towards the center of each said stirrup member than they are towards the ends of each said stirrup member.

7. The method of claim 1 which comprises:

determining a first diameter of wire necessary for a longitudinal sinusoidal stirrup reinforcement, were such to be used to reinforce a concrete pipe reinforcing cage of the desired size and configuration, in which each of such longitudinal sinuoidal stirrup members would be oriented to extend longitudinally with respect to a cage;

said step of providing said circumferentially oriented mat then including providing a mat of sinusoidal stirrup members in which the wire used in said generally sinusoidal stirrup members has a second diameter which is approximately half said first diameter of wire.

8. The method of claim 1 in which the tops of said nodes of adjacent stirrup members are joined together by top tie wires which extend generally parallel to each other and to said bottom tie wires.

* * * * *

UNITED STATES PATENT AND TRADEMARK OFFICE

CERTIFICATE OF CORRECTION

PATENT NO. : 4,345,626

DATED : August 24, 1982

INVENTOR(S) : Wilbur E. Tolliver

It is certified that error appears in the above—identified patent and that said Letters Patent is hereby corrected as shown below:

Column 1, line 32:

Remove "(" before the word stirruping

Column 1, line 43:

"VARAGATED" should be --VARIEGATED--

Column 1, line 44:

Insert "issued October 20, 1981" after 4,295,497

Column 1, line 57:

"varegated" should be --variegated--

Column 2, line 4:

"then" should be --than--

Column 2, line 15:

"circumferentially" should be --circumferential--

Column 3, line 29:

"springyness" should be --springiness--

UNITED STATES PATENT AND TRADEMARK OFFICE

CERTIFICATE OF CORRECTION

PATENT NO. : 4,345,626 PAGE 2 OF 2

DATED : August 24, 1982

INVENTOR(S) : Wilbur E. Tolliver

It is certified that error appears in the above—identified patent and that said Letters Patent is hereby corrected as shown below:

Column 3, line 56:

"varegated" should be --variegated--

Column 3, line 62:

"varegation" should be --variegation--

Signed and Sealed this

*Fourteenth* Day of *December 1982*

[SEAL]

*Attest:*

GERALD J. MOSSINGHOFF

*Attesting Officer* *Commissioner of Patents and Trademarks*